US006092560A

United States Patent [19]

Burkert

[11] Patent Number: 6,092,560

[45] Date of Patent: Jul. 25, 2000

[54] SHAFT DRIVING DEVICE FOR HEALD SHAFTS

[75] Inventor: Martin Burkert, Bayreuth, Germany

[73] Assignee: Staeubli GmbH, Bayreuth, Germany

[21] Appl. No.: 09/089,179

[22] Filed: Jun. 2, 1998

[30] Foreign Application Priority Data

Jul. 30, 1997 [DE] Germany ..... 297 13 600

[51] Int. Cl.[7] ..... D03C 1/14

[52] U.S. Cl. ..... 139/57; 139/84

[58] Field of Search ..... 139/57, 84

[56] References Cited

U.S. PATENT DOCUMENTS 4,651,784 3/1987 Rambousek et al. ..... 139/57
5,740,840 4/1998 Lindahl ..... 139/57

FOREIGN PATENT DOCUMENTS 196 23 173
A1 12/1996 Germany .

*Primary Examiner*—Andy Falik
*Attorney, Agent, or Firm*—Flynn, Thiel, Boutell & Tanis, P.C.

[57] ABSTRACT

A shaft driving device for driving a plurality of heald shafts arranged in parallel comprises respective shaft raising elements each associated with a heald shaft and provided with a linkage and a plurality of lever elements connecting the linkage to the respective heald shaft. Drive apparatus are arranged on opposite ends of the heald shafts. The drive apparatus are drivingly connected to ends of juxtaposed shaft raising elements which face the drive apparatus. The cross-sectional dimensions of each linkage in the direction of the neighboring shaft raising element can be larger in the end of the shaft raising element facing the drive apparatus than in the end facing away from the drive apparatus.

15 Claims, 4 Drawing Sheets

SHAFT DRIVING DEVICE FOR HEALD SHAFTS

FIELD OF THE INVENTION

The present invention refers to a shaft driving device used for looms for weaving wide fabrics and for looms for weaving industrial fabrics, which are used for weaving e.g. mesh fabrics for paper production.

BACKGROUND OF THE INVENTION

The present invention especially refers to a shaft driving device for driving a plurality of heald shafts arranged in parallel, said shaft driving device comprising respective shaft raising elements each associated with a heald shaft and provided with a linkage and a plurality of lever elements connecting the linkage to the respective heald shaft, and further comprising drive means which are arranged on opposite front sides of the heald shafts, alternate said drive means on opposite sides being drivingly connected to those ends of juxtaposed shaft raising elements which face said drive means.

Such a shaft driving device according to the prior art is shown in FIG. 4A. The shaft driving device 400 is designed for driving a plurality of heald shafts 410 and 410', two respective ones of said heald shafts 410 and 410' being shown in FIG. 4A. In said heald shafts one heald or a plurality of healds 412 and 412' are provided for heddling warp threads. By heddling warp threads in the plurality of heald shafts and by a suitable position of the individual heald shafts relative to one another, it will be possible to open, in the manner known, a weaving shed into which weft threads can be woven with the aid of suitable means.

In this known device, each heald shaft 410 is driven via a respective shaft raising element in a driving direction 411 by a respective drive means 450, which is provided on the left front side of the heald shaft arrangement according to FIG. 4A.

Each shaft raising element comprises a linkage 420 which is connected to the heald shaft 410 by means of a plurality of lever elements 430. Each linkage 420 is provided in the form of a connecting rod having an approximately uniform cross-section.

The heald shafts 410' are driven via a suitable mechanism with the aid of a drive means 450', i.e. each of said heald shafts is driven via a shaft raising element provided with a linkage 420' connected to the heald shaft 410' by means of a plurality of lever elements 430'. The drive means 450' for the heald shafts 410' are provided on the right front side of the heald shaft arrangement.

FIG. 4A additionally shows, under the connecting rod of the linkage 420 of the first shaft raising element, the pulling and pushing forces 470 acting on respective points of the connecting rod while the first heald shaft is being driven.

As can be seen from FIG. 4A, this force is highest on the side facing the drive means 450. The force required for moving all the lever elements 430 must there be taken up by the connecting rod. After each lever element, this force acting on the connecting rod of the linkage 420 is reduced by the amount required for driving the lever element 430 in question.

In order to enable the connecting rods 420 and 420' to take up the above-described pushing and pulling forces when the respective heald shafts are being driven, each connecting rod must be implemented such that it is rigid and buckle-proof depending on the forces occurring. Hence, the lever elements must have at least certain minimum cross-sectional dimensions in the direction of the neighbouring shaft raising element.

Especially in the case of looms for weaving wide fabrics and looms for weaving industrial fabrics, in which high pressing and pulling forces occur, this requirement will, however, result in comparatively large cross-sectional dimensions (cf. FIG. 4B) of the connecting rods in the direction of the neighboring shaft raising element.

FIG. 4B shows a sectional view along line IV—IV in FIG. 4A. In this sectional view, the four linkages 420 and 420' of the shaft raising elements and the heald shafts 410 and 410' associated therewith are shown. In addition, the healds 412 and 412' for heddling the warp threads are shown in this figure.

Furthermore, the distance between the heald shafts 410 and 410' of two neighboring shaft raising elements is designated by reference numeral 413 and the distance between the linkages 420, 420' in the direction of the neighboring shaft raising element is designated by reference numeral 425.

As can additionally be seen from FIG. 4B, also the minimum distance 413 between the healds 412, 412' of neighboring heald shafts 410, 410' is given by the cross-sectional dimensions, which are predetermined by the force applied to the linkage 420 by the respective drive means 450 in the direction of the neighboring shaft raising element. It follows that, in view of comparatively large cross-sectional dimensions, also a comparatively large minimum distance between the heald shafts 410 and 410' is also obtained.

This comparatively large distance 413 between neighboring heald shafts 410 and 410' makes it necessary that especially the rear heald shafts must carry out a comparatively large lifting motion for opening a weaving shed.

This comparatively large lifting motion has, in turn, the effect that the force required for driving the heald shafts 410, 410' must be very large and that the connecting rods of the linkages 420, 420' must be provided with correspondingly large cross-sectional dimensions.

In view of these disadvantages of the prior art, it is the object of the present invention to improve a shaft driving device in such a way that the above-described disadvantages can be avoided.

SUMMARY OF THE INVENTION

This object is achieved by a device of the type mentioned at the beginning, which is characterized in that the cross-sectional dimensions of each linkage in the direction of the neighboring shaft raising element are larger in the end of the shaft raising element facing the drive means than in the end facing away from the drive means.

By means of this structural design of a linkage, additional space is provided in the area facing away from the drive means. This additional space can then be occupied by the end of a neighboring linkage which faces a respective drive means.

In other words, this means that, in the case of neighboring shaft raising elements, the end having smaller cross-sectional dimensions of one linkage is opposed to the end having larger cross-sectional dimensions of the other linkage and vice versa, since the shaft raising elements are driven from the left and from the right, in turn or alternately, in relation to the heald shaft arrangement.

This allows the distance between two neighboring linkages to be reduced. This directly results in the possibility of reducing the thickness of two neighboring heald shafts. In this way the heald shafts can be arranged closer to one another so that, in total, they extend over a shorter distance in the direction of the shed. This results in a reduction of the lifting motions of the rear heald shafts which are required for opening a specific shed.

On the other hand, it is now possible to provide a larger number of heald shafts in the case of one shed, when the height of the lifting motion of the rearmost heald shaft is maintained.

According to an advantageous further devlopment, the linkage comprises a first section facing the drive means and a second section facing away from the drive means. The cross-sectional dimensions of the first section are larger than those of the second section. In addition, the lengths of the first and second sections are dimensioned such that the linkages of two respective neighboring shaft raising elements are not opposed to one another in the area of the first sections thereof.

By means of this advantageous further development, a shaft raising element is provided, which has a simple structural design and which can, consequently, be produced at a comparatively moderate price.

According to another advantageous further development, the linkage can comprise a first section facing the drive means and a second to nth section following said first section, with $n \geqq 3$. The cross-sectional dimensions of each of the first to nth sections are here constant and decrease from the first to the nth section. The lengths of the first to nth sections are dimensioned such that the linkages of two respective neighboring shaft raising elements are not opposed to one another in the area of the first sections thereof.

In comparison with the advantageous further development described in the last paragraph, the distance between the healds of two neighboring heald shafts and, consequently, the lifting motions of rear heald shafts, which are required for opening a specific shed, can be reduced still further by means of this structural design.

In the embodiments described hereinbefore, the cross-sectional profile can be a rectangular profile. This permits the connecting rods to be produced at a comparatively moderate price.

According to another advantageous embodiment, the linkage can be implemented such that its cross-sectional dimensions linearly decrease from the end facing the drive means.

Due to their arrangement from the left and from the right front side, two neighbouring linkages have complementary shapes in the plane in which all linkages are arranged. This structural design permits the maximum reduction of the distance between the healds of two neighboring heald frames.

In accordance with an advantageous embodiment, the above-described cross-sectional dimensions can be dimensioned in dependence upon the pulling and pushing forces, respectively, which act on the linkage when the heald shaft is being driven. This will guarantee that, on the one hand, the distance between the healds of neighboring heald shafts becomes as small as possible and that, on the other hand, the device is dimensioned such that the driving force can be transmitted to the heald shaft without damage being caused to the linkage.

The above-described object is also achieved by means of a device of the type mentioned at the beginning, which is characterized in that two respective neighboring linkages are arranged in such a way that they are located in different planes extending at right angles to the driving direction of the heald shafts, at any possible position.

Due to the fact that they are formed in different planes, only the linkages which are driven from one side are opposed to one another. In other words, the juxtaposed arrangement of linkages comprises only every second linkage.

This allows the distance between two neighboring linkages to be reduced. This directly results in the possibility of reducing the distance between the healds of two neighboring heald shafts and, consequently, in the possibility of reducing the lifting motion of the heald shafts, which is required for opening a specific shed.

In accordance with an advantageous embodiment, the cross-sectional profile of the linkages can be a rectangular profile. This will again permit a simple structural design and the device can therefore be produced at a comparatively moderate price.

The above-described object is also achieved by means of a device of the type mentioned at the beginning, which is characterized in that the linkage comprises a first connecting rod facing the drive means and a second connecting rod which is connected to the first connecting rod by means of a connecting element. The first connecting rod has cross-sectional dimensions in the direction of the neighboring shaft raising element which are larger than the cross-sectional dimensions of the second connecting rod. At each position, the first and second connecting rods are located in different planes extending at right angles to the driving direction of the heald shaft, and that the lengths of the first and second connecting rods are dimensioned such that the first connecting rods of two respective neighboring shaft raising elements are not opposed to one another.

On the basis of such a structural design, two connecting rods of a respective linkage are provided in superimposed planes. It follows that, since the shaft raising elements are driven from the left and from the right, in turn, in relation to the heald shaft arrangement, the respective ends having smaller and larger cross-sectional dimensions of each second linkage are opposed to one another in the direction of the heald shaft arrangement. In other words, the respective shaft raising elements driven from one front side are arranged in neighboring relationship with one another.

This allows the distance between two neighboring linkages to be reduced, and this directly results in a reduction of the distance between the healds of two neighboring heald shafts and, consequently, in a reduction of the lifting motion of the heald shafts, which is required for opening a specific shed.

Since the second connecting rods of neighboring shaft raising elements are opposed to one another in an area of the shaft raising elements, the minimum distance that can exist between two neighboring shaft raising elements is in this case given by the cross-sectional dimensions of the second connecting rods.

In accordance with an advantageous embodiment, the cross-sectional profiles of the first and of the second connecting rod can be rectangular profiles. This finally permits a simple structural design and the device can therefore be produced at a comparatively moderate price.

According to an advantageous embodiment, the cross-sectional dimensions can be dimensioned in dependence upon the pulling and pushing forces, respectively, which act on the first and second connecting rods when the heald shaft is being driven. This will guarantee that the distance between the healds of neighboring heald shafts becomes as small as possible and that the device is dimensioned such that the driving force can be transmitted to the heald shaft without damage being caused to the linkage.

According to another advantageous further development the drive means of all the above-mentioned embodiments can be controlled on a respective one of the front sides by a respective control means.

Additional advantages of special further developments can also be inferred from the description of the preferred embodiment.

BRIEF DESCRIPTION OF THE DRAWINGS

In the following, the present invention will be explained in detail on the basis of embodiments shown in the drawing, in which.

DETAILED DESCRIPTION

Figures 1A, 1B:
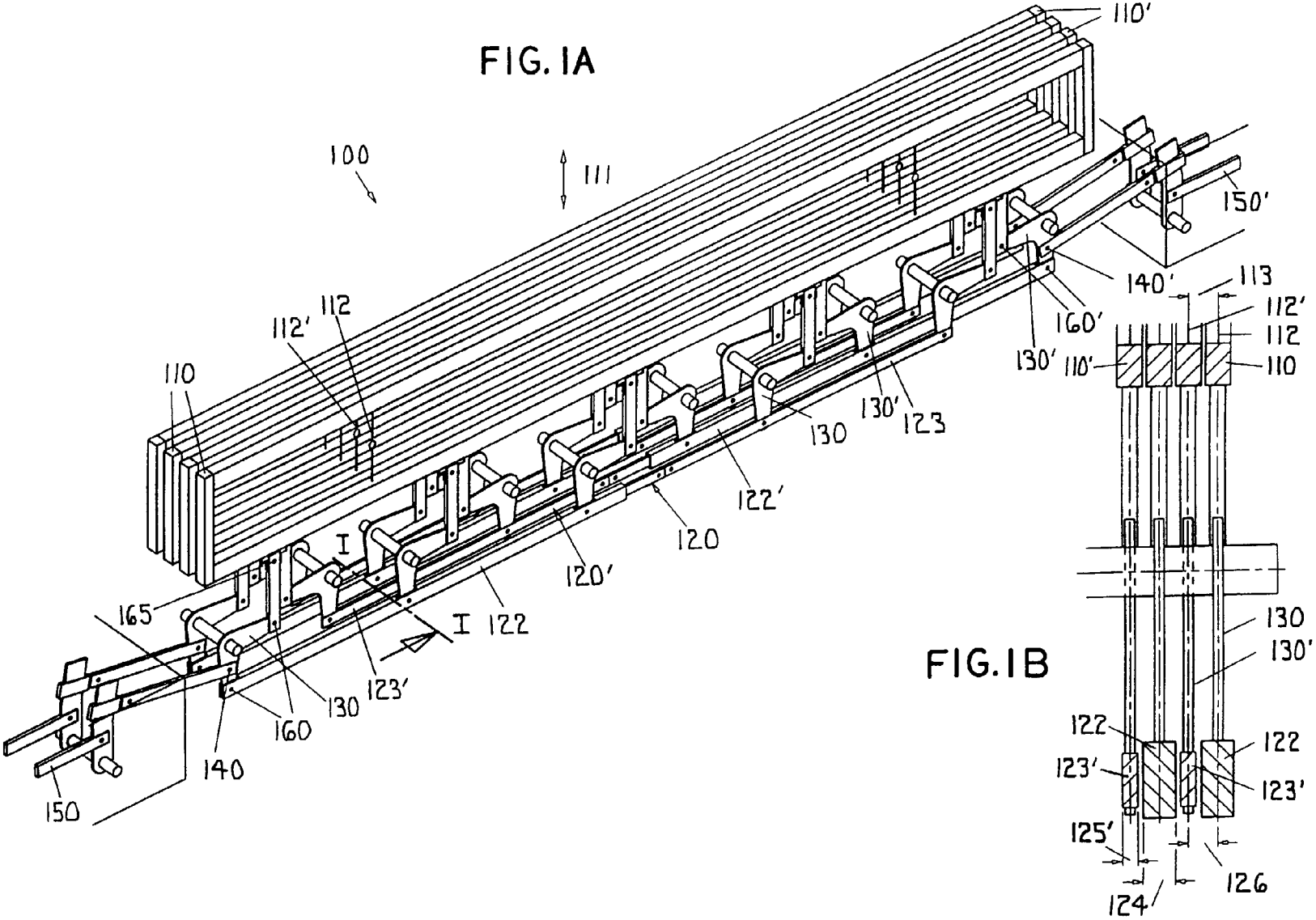
FIG. 1A shows a schematic representation of a first embodiment of the shaft driving device according to the present invention.
FIG. 1B shows a sectional view along line I—I in FIG. 1A.

Making reference to FIGS. 1A and 1B, a first embodiment of a shaft driving device 100 according to the present invention is now described in detail.

FIG. 1A shows a schematic view of a shaft driving device 100 which is adapted to drive a plurality of heald shafts 110 and 110', two respective ones of said heald shafts 110 and 110' being shown in FIG. 1A.

For driving each heald shaft in a driving direction 111, the device 100 comprises drive means or drive apparatus, which are arranged either on the left or on the right front side of the heald shafts according to FIG. 1A and which are designated by reference numerals 150 and 150' accordingly.

The drive means can be connected to a suitable control means (not shown). In the present arrangement, e.g. a rotary heald loom can be used for controlling all the drive means 150 and all the drive means 150', respectively. It is, of course, also possible to control the drive means 150 and 150' individually or in predetermined groups by other suitable control means, which are known to the person skilled in the art.

Each drive means 150 and 150' is drivingly connected to a shaft raising element at a respective end 140 and 140' of the shaft raising element. The shaft raising element is, in turn, connected to a respective heald shaft.

The drive means 150 and 150', the shaft raising elements connected to the respective drive means, and the heald shafts 110 and 110' connected to said shaft raising elements are arranged in the device in such a way that one heald shaft 110 is driven from the left front side of the heald shafts and one heald shaft 110' from the right front side of said heald shafts in turn or alternately when there are two heald shafts.

Each shaft raising element includes a linkage 120 and 120', respectively, and a plurality of lever elements 130 and 130', respectively.

The linkages 120 and 120' according to FIG. 1A each comprise a first section 122 and 122', respectively, and a second section 123 and 123', respectively. As can be seen from this figure, the first section 122 of a linkage 120 driven from the left-hand side is arranged in opposed relationship with the second section 123' of the neighboring linkage 120' driven from the right-hand side. The same mode of arrangement is also provided in the case of the first section 122' of a linkage 120' driven from the right-hand side and in the case of the second section 123 of a neighboring linkage 120 driven from the left-hand side. In the transition area between the first and second sections of the two neighbouring linkages only the respective second sections 123 and 123' of the neighbouring linkages are opposed to one another.

The lever elements 130 and 130' are provided in the form of intermediate levers having one of their ends articulated on the linkages 120 and 120', respectively, via bearings 160 and 160', and having their other end articulated on the heald shaft via bearings 165. A lever element of the type used in the present invention is well known to the person skilled in the art (cf. e.g.: DE 196 23 173 A1); hence, a more detailed description of the lever elements 130 and 130' can be dispensed with.

The lever elements 130 and 130' are preferably implemented such that their cross-sectional dimensions in the direction of the neighboring heald shaft are smaller than the cross-sectional dimensions of the linkages 120, 120'. This allows the linkages 120, 120' to be arranged at the smallest possible distance from one another.

In FIG. 1B, a sectional view of the device 100 along line I—I is shown. In this figure, reference numeral 122 designates the first section of a linkage 120 driven from the left-hand side and reference numeral 123' designates the second section of a linkage 120' driven from the right-hand side.

Both sections according to this embodiment are rectangular in cross-section, the cross-sectional dimensions of the first section 122 in the direction of the neighboring shaft raising element being larger than the cross-sectional dimensions of the second section 123'. The present invention is, however, not limited to this embodiment. It is also possible to use linkages whose sections have a cross-section that deviates from the rectangular shape, e.g. a circular or an elliptical cross-section. Also when shapes of this kind are used, it is only the cross-sectional dimension in the direction of the next shaft raising element that matters as far as the present invention is concerned.

Furthermore, the lever elements 130 and 130' as well as the heald shafts 110 and 110' with the healds 112 and 112' are shown in this figure.

As has already been explained hereinbefore and as can also be seen from FIG. 1B, a first linkage section 122 having larger cross-sectional dimensions is always arranged in neighboring opposed relationship with a second linkage section 123' having smaller cross-sectional dimensions.

Figures 4A, 4B:
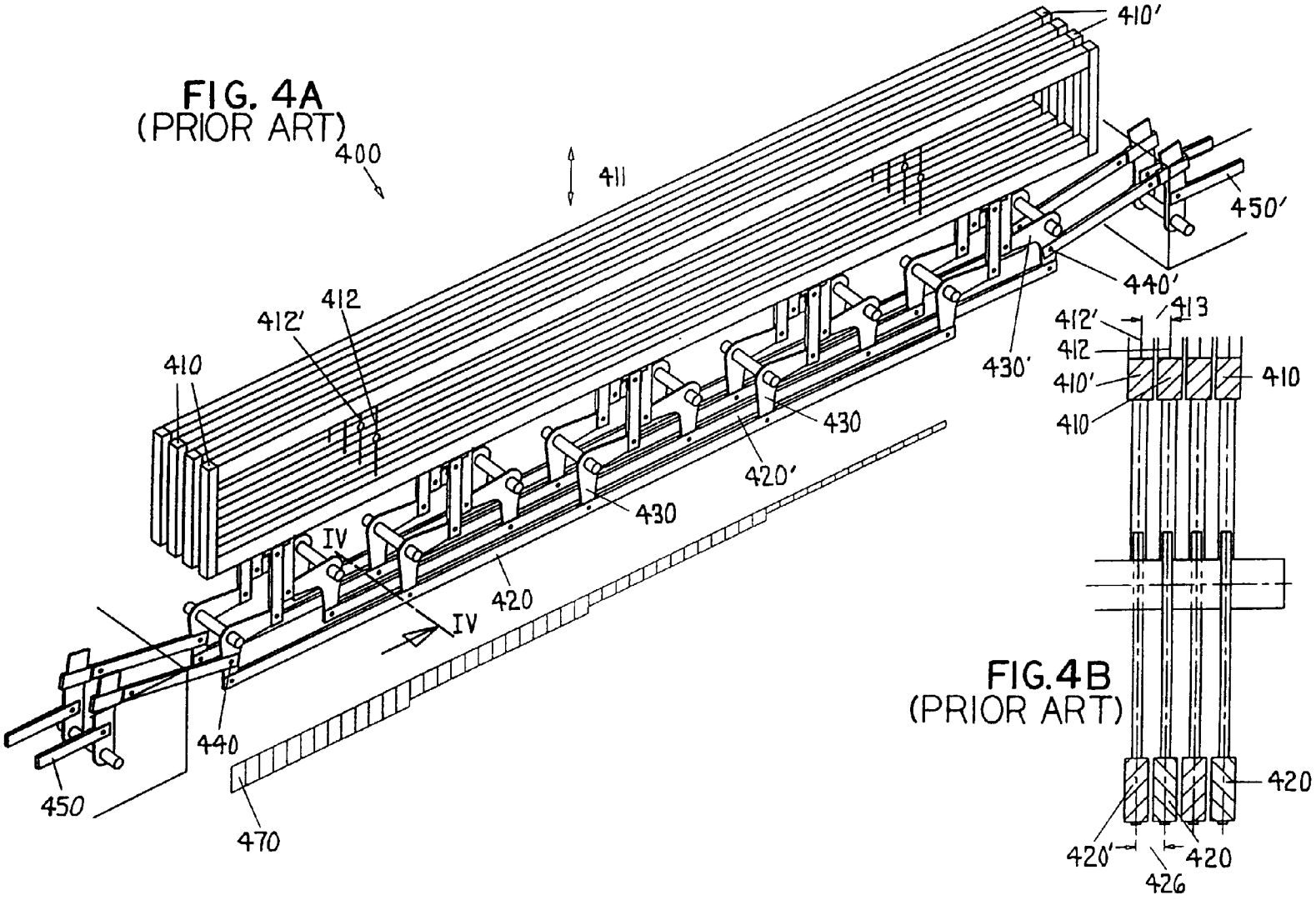
FIG. 4A (PRIOR ART)
FIG. 4B (PRIOR ART)
FIG. 4A shows a schematic representation of a shaft driving device according to the prior art.
FIG. 4B shows a sectional view along line IV—IV in FIG. 4A.

Hence, it can be directly inferred from FIG. 1B that, in comparison with the prior art which is shown according to FIG. 4B, the distance 126 between the linkages 120 and 120' of two neighboring shaft raising elements can be reduced.

As can also be seen from FIG. 1B, this has the immediate consequence that also the distance 113 between the healds 112 and 112' of two neighboring shaft raising elements becomes smaller. It follows that, in the final analysis, also the lifting motions, especially those of the rear healds, which are required for opening a weaving shed will become smaller.

Alternatively to a connecting rod comprising two sections 122, 123, as shown in FIG. 1A, it is also possible to provide connecting rods comprising a plurality of sections. The linkage 120 can, for example, comprise a first section which faces the drive means and which is followed by a second to nth section, with $n \geqq 3$, the cross-sectional dimensions of each of the first to nth section being constant and decreasing from said first to said nth section. The lengths of the first to nth section must be dimensioned such that the respective linkages of two neighboring shaft raising elements are not arranged in opposed relationship with one another in the area of their first sections.

According to a further alternative, the connecting rod can be implemented such that its cross-sectional dimensions vary linearly in the direction of the neighboring shaft raising element. Due to this structural design, two neighboring connecting rods have, in view of the fact that they are driven from the left-hand and from the right-hand side, respectively, a complementary shape in the direction of the neighboring shaft raising element. It follows that the smallest distance between two neighboring shaft raising elements can be achieved on the basis of this structural design.

Figures 2A, 2B:
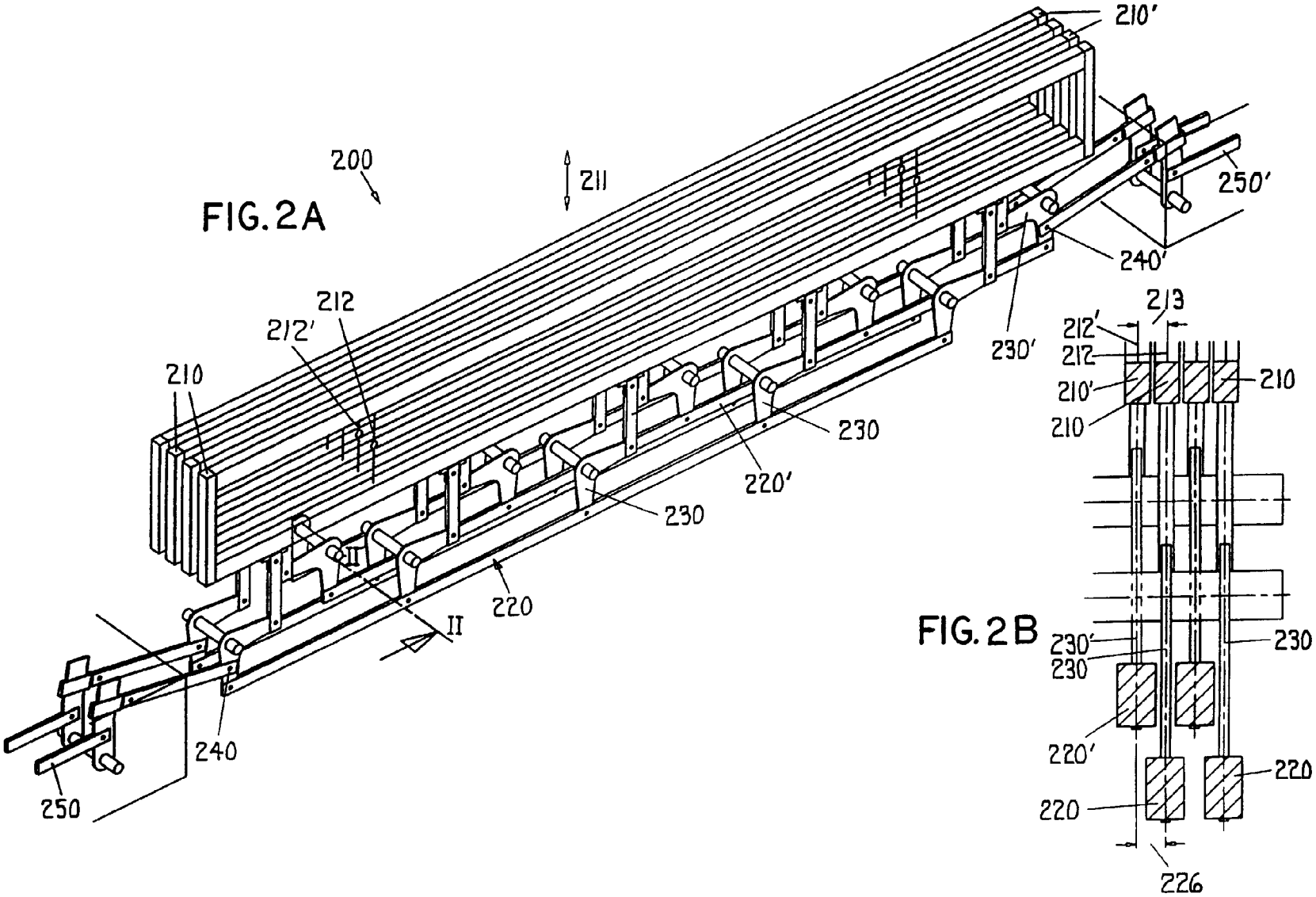
FIG. 2A shows a schematic representation of a second embodiment of the shaft driving device according to the present invention.
FIG. 2B shows a sectional view along line II—II in FIG. 2A.

In FIGS. 2A and 2B, a further embodiment of a shaft driving device according to the present invention is shown. FIG. 2A shows a shaft driving device 200 in an oblique schematic view and FIG. 2B shows a sectional view of said shaft driving device along line II—II which is shown in FIG. 2A.

In FIGS. 2A and 2B, the features which are already known from the description of the first embodiment are designated by corresponding reference numerals (the reference numerals of the corresponding features differ only with regard to their first number). In order to avoid repetition, the respective passages of the description of the first embodiment are referred to for describing these common features, and, in the following, only the differences between these two embodiments will be described.

The shaft driving device shown in FIG. 2A differs from the first embodiment only with regard to the structural design of the shaft raising elements.

It is true that the shaft driving device 200 also comprises shaft raising elements each including a linkage 220 and 220', respectively, and a plurality of lever elements 230 and 230', respectively. In addition, the device 200 also comprises drive means or drive apparatus 250 and 250', respectively, which are arranged like those of the first embodiment, i.e. two successive heald shafts 210 and 210' are driven from the left front side of the heald shafts and from the right front side of the heald shafts in turn.

But, according to this embodiment, the linkages 220, 220' are provided as connecting rods having a cross-section which does not change throughout the length of the rods. In addition, the connecting rods of the linkages 220, 220' of two neighboring shaft raising elements have the same cross-sectional dimensions 124 (see FIG. 1B) in the direction of the neighboring or adjacent shaft raising element.

Moreover, two respective neighboring linkages 220, 220' comprise connecting rods arranged such that they are located in different planes extending at right angles to the driving direction 211 at any possible position which the two connecting rods can occupy relative to one another.

According to the embodiment shown, the connecting rods are additionally arranged in such a way that, when the drive means 250 and 250' occupy identical positions, all linkages 220 comprising connecting rods are located in one plane and all linkages 220' comprising connecting rods are located in a plane which is parallel to the first-mentioned plane.

FIG. 2B shows a cross-section along line II—II in FIG. 2A. In this cross-section especially the lever elements 230 and 230' as well as the linkages 220, 220' comprising corresponding connecting rods of two neighboring shaft raising elements are shown.

As can immediately be seen from FIG. 2B, the distance 226 of two neighboring shaft raising elements can be substantially reduced in comparison with the prior art (cf. FIG. 4A). Thus, the connecting rods of two neighboring shaft raising elements are located in different planes at any position which they can occupy.

Furthermore, it is directly evident from FIG. 2B that the minimum distance which must exist between two neighbouring shaft raising elements is given by the cross-sectional dimensions of the linkages 220, 220' comprising respective connecting rods and by the cross-sectional dimensions of the lever elements 230 and 230', respectively.

Also in the case of this embodiment, the distance between two neighboring shaft raising elements can be reduced in comparison with the prior art, this will directly result, as has already been explained in connection with the first embodiment, in smaller lifting motions for the necessary opening of a weaving shed, especially in smaller lifting motions of the rear healds.

Figures 3A, 3B:
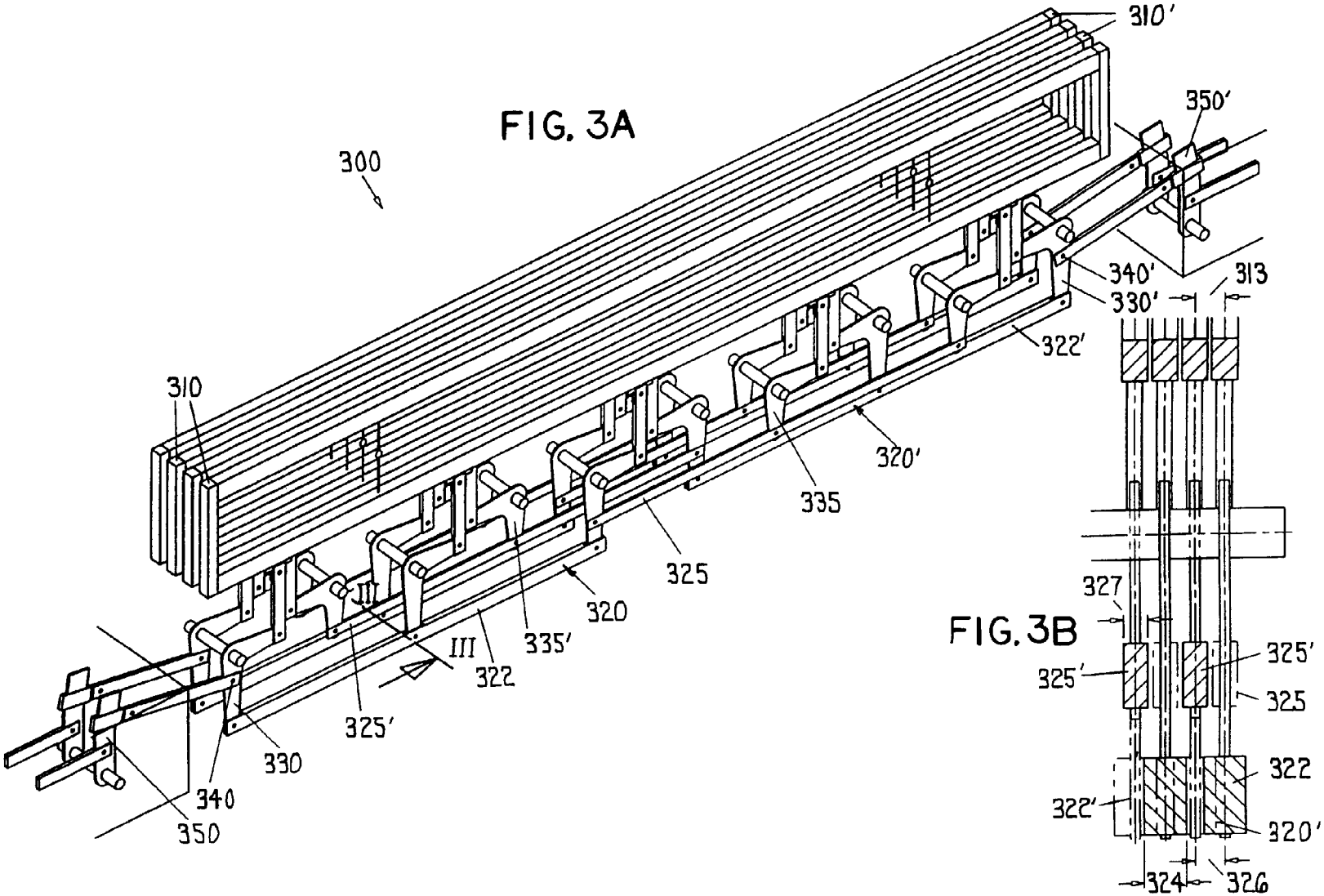
FIG. 3A shows a schematic representation of a third embodiment of the shaft driving device according to the present invention.
FIG. 3B shows a sectional view along line III—III in FIG. 3A.

FIGS. 3A and 3B show a further embodiment of a shaft driving device according to the present invention. FIG. 3A shows a shaft driving device 300 in an oblique schematic view and FIG. 3B shows a sectional view of the shaft driving device along line III—III which is shown in FIG. 3A.

In these figures, the features which are already known from the description of the first embodiment are again designated by corresponding reference numerals (the reference numerals of the corresponding features differ only with regard to their first number). In order to avoid repetitions, the respective passages of the description of the first embodiment are again referred to for describing these known features, and, in the following, only the differences between these two embodiments will be described.

The shaft driving device shown in FIG. 3A differs from the first embodiment again with regard to the structural design of the shaft raising elements.

Each shaft driving device 300 according to this third embodiment, comprises a linkage 320 and 320', respectively, which is connected to drive means or drive apparatus 350 and 350', respectively. Each of the linkages 320, 320' have articulated thereon a plurality of lever elements 330 and 330' for establishing a connection with the heald shafts 310 and 310'. Each of the linkages 320, 320' is, however, provided with a first connecting rod 322 and 322' as well as with a second connecting rod 325 and 325' connected thereto.

The first and second connecting rods of each linkage 320 and 320' are arranged such that they are located in different planes extending at right angles to the driving direction of the heald shafts 310 and 310'. According to FIG. 3A, the two connecting rods 322, 325 are interconnected via one of the plurality of lever elements 330 connecting the first connecting rod 322 to the heald shaft 310. The connecting rods 322', 325' are connected to the heald shaft 310' in a similar way.

In view of the arrangement in different planes, two different lever elements 330, 330' and 335, 335' are provided. The lever elements 330 and 330' serve to connect the first connecting rods 322 and 322', respectively, to the heald shafts 310, 310', whereas the lever elements 335 and 335' serve to connect the second connecting rods 325 and 325' to the heald shafts.

In addition, the length of each of the first and second connecting rods 310, 310' is dimensioned such that the first connecting rod 322 of a shaft raising element driven from the left front side is located in neighboring relationship with the second connecting rod 325' of a shaft raising element driven from the right front side. The second connecting rod 325 of a shaft raising element driven from the left front side is located in neighboring relationship with the first connecting rod 322' of a shaft raising element driven from the right front side. In a transition area between the first and second connecting rods of neighboring shaft raising elements, only the respective second connecting rods 325 and 325' of the neighboring shaft raising elements are opposed to one another.

FIG. 3B shows a cross-section through the device 300 along line III—III shown in FIG. 3A.

In this representation, reference numeral 322 designates the first connecting rod and 325 the second connecting rod of a linkage driven from the left-hand side in FIG. 3A, and reference numeral 322' designates the first connecting rod and 325' the second connecting rod of a linkage 320' driven from the right-hand side.

Both connecting rods according to this embodiment are rectangular in cross-section. The cross-sectional dimensions 324 and 324' of the first connecting rods 322, 322' in the direction of the neighboring shaft raising element are larger than the cross-sectional dimensions 327 and of the second connecting rods 325, 325'.

The present invention is, however, not limited to this embodiment. It is also possible to use linkages whose sections have a cross-section that deviates from the rectangular shape, e.g. a circular or an elliptical cross-section. Also when shapes of this kind are used, it is only the cross-sectional dimension in the direction of the next shaft raising element that matters as far as the present invention is concerned.

As has already been explained hereinbefore and as can also be seen from FIG. 3B, a first connecting rods 322 and 322', respectively, which have larger cross-sectional dimensions are always arranged in neighboring opposed relationship with second connecting rods 325' and 325, respectively, which have smaller cross-sectional dimensions.

Hence, it can directly be inferred from FIG. 3B that, in comparison with the prior art which is shown according to FIG. 4B, the distance 326 between the linkages 320, 320' of two neighboring shaft raising elements can be reduced by means of this arrangement.

This will also result in a reduced distance between the healds of two neighboring shaft raising elements for the shaft driving device 300, whereby the lifting motions, especially those of the rear healds, can be reduced again.

I claim:

1. An apparatus comprising a shaft driving device and a plurality of heald shafts, said shaft driving device driving a plurality of heald shafts arranged in parallel, said shaft driving device comprising:

respective shaft raising elements each associated with a respective one of said heald shafts and provided with a linkage, and a plurality of lever elements connecting said linkage to said respective heald shaft, and alternate drive means which are arranged on opposite front sides of said heald shafts, said alternate drive means on the opposite sides being drivingly connected to ends of juxtaposed ones of said shaft raising elements which face said respective drive means, wherein the cross-sectional dimensions of each said linkage in the direction of a neighboring one of said shaft raising elements are larger at the end of said shaft raising element secured to said drive means than at the opposing end facing away from said drive means.

2. An apparatus according to claim 1, wherein said linkage comprises a first section secured to said alternate drive means and a second section facing away from said drive means, the cross-sectional dimensions of each of the first sections are constant and the cross-sectional dimensions of the first section are larger than those of the second section, and the lengths of the first and second sections are dimensioned such that said linkages of respective said neighboring shaft raising elements are not opposed to one another in the area of the first sections thereof.

3. An apparatus according to claim 1, wherein said linkage comprises a first section secured to said drive means and second to nth sections following said first section, with $n \geqq 3$, the cross-sectional dimensions of each of the first to nth sections are constant and decrease from the first to the nth section, and the lengths of the first to nth sections are dimensioned such that said linkages of respective said neighboring shaft raising elements are not opposed to one another in the area of the first sections thereof.

4. An apparatus according to claim 2, wherein the cross-sectional profile of the sections of said linkage is a rectangular profile.

5. An apparatus according to claim 1, wherein each said linkage is implemented such that its cross-sectional dimensions linearly decrease from the end secured to said drive means.

6. An apparatus according to claim 1, said plurality of lever elements being articulated on said linkage by bearing means, and wherein the cross-sectional dimensions of each said linkage are dimensioned in dependence upon pulling and pushing forces, respectively, which act on said linkage when said heald shaft is being driven.

7. An apparatus according to claim 1, wherein said plurality of lever elements are articulated on said linkage by bearing means such that said lever elements are centered with respect to the cross-section of said linkage, and the cross-sectional dimensions of said lever elements in the direction of said neighboring heald shaft are smaller than the cross-sectional dimensions of said linkage.

8. An apparatus comprising a shaft device and a plurality of heald shafts, said shaft driving device driving a plurality of said heald shafts arranged in parallel, said shaft driving device comprising:

respective shaft raising elements each associated with a respective one of said heald shafts and provided with one of a plurality of linkages, and a plurality of lever elements connecting said linkage to said respective heald shaft, and alternate drive means which are arranged on opposite front sides of said heald shafts, said drive means on the opposite sides being drivingly connected to ends of juxtaposed ones of said shaft raising elements which face said respective drive means, wherein two respective neighboring ones of said linkages are located in different planes extending at right angles to the driving direction of said heald shafts at any possible position which said two linkages can occupy relative to one another.

9. An apparatus according to claim 8, wherein the cross-sectional profile of said linkages is a rectangular profile.

10. An apparatus according to claim 8, wherein said plurality of lever elements are articulated on said linkages by bearing means such that said lever elements are centered with respect to the cross-section of respective said linkages, and the cross-sectional dimensions of said lever elements in the direction of said neighboring shaft raising element are smaller than the cross-sectional dimensions of said linkages in the direction of said neighboring shaft raising element.

11. An apparatus comprising a shaft driving device and a plurality of heald shafts, said shaft driving device driving said plurality of said heald shafts arranged in parallel, said shaft driving device comprising:

respective shaft raising elements each associated with one of said heald shafts and provided with a linkage and a plurality of lever elements connecting said linkage to the respective said heald shaft, and alternate drive means which are arranged on opposite front sides of said heald shafts, said drive means on the opposite sides being drivingly connected to ends of juxtaposed ones of said shaft raising elements which face said respective drive means, wherein said linkage comprises a first connecting rod facing said drive means and a second connecting rod which is connected to said first connecting rod by means of a connecting element, wherein said first connecting rod has cross-sectional dimensions in the direction of the neighboring said shaft raising element which are larger than the cross-sectional dimensions of said second connecting rod, at each position said first and second connecting rods are located in different planes extending at right angles to the driving direction of said heald shafts, and the lengths of said first and second connecting rods are dimensioned such that said first connecting rods of two respective said neighboring shaft raising elements are not opposed to one another.

12. An apparatus according to claim 11, wherein one of said plurality of lever elements comprises said connecting element.

13. An apparatus according to claim 11, wherein the cross-sectional profiles of said first and of said second connecting rod are rectangular profiles.

14. An apparatus according to claim 11, said plurality of lever elements being articulated on said linkage by bearing means, and wherein the cross-sectional dimensions of said first and of said second connecting rod are dimensioned in dependence upon pulling and pushing forces which act on said connecting rods when said heald shaft is driven.

15. An apparatus according to claim 11, wherein said plurality of lever elements are articulated on said first and second connecting rods by bearing means such that said lever elements are centered with respect to the cross-sections of said first and second connecting rods, respectively, and the cross-sectional dimensions of said plurality of lever elements connected to said first connecting rod are, in the direction of said neighboring shaft raising element, smaller than the cross-sectional dimensions of said first connecting rod, and the cross-sectional dimensions of said bearing means for said second lever elements are, in the direction of said neighboring shaft raising element, smaller than the cross-sectional dimensions of said second connecting rod.

* * * * *